United States Patent [19]

Slattery

[11] 4,312,308

[45] Jan. 26, 1982

[54] COMPRESSION RELIEF SYSTEM FOR INTERNAL COMBUSTION ENGINE

[76] Inventor: Gordon C. Slattery, 6435 Springbrook Rd., Omro, Wis. 54963

[21] Appl. No.: 123,331

[22] Filed: Feb. 21, 1980

[51] Int. Cl.[3] ..... F02B 75/06

[52] U.S. Cl. ..... 123/182; 123/65 A; 123/65 EM; 123/65 PE

[58] Field of Search ..... 123/182, 65 EM, 65 PE, 123/65 A, 59 B, 59 BM

[56] References Cited

U.S. PATENT DOCUMENTS

| | | | |
|---|---|---|---|
| 1,377,139 | 5/1921 | Murphy | 123/182 |
| 2,947,300 | 8/1960 | Trapp | 123/182 |
| 3,538,899 | 11/1970 | Burkett | 123/182 |
| 4,121,552 | 10/1978 | Mithuo | 123/182 |

FOREIGN PATENT DOCUMENTS

| | | | |
|---|---|---|---|
| 2322537 | 11/1973 | Fed. Rep. of Germany | 123/182 |
| 2453193 | 5/1975 | Fed. Rep. of Germany | 123/182 |
| 1221253 | 2/1971 | United Kingdom | 123/182 |
| 1386177 | 3/1975 | United Kingdom | 123/182 |

*Primary Examiner*—Wendell E. Burns

[57] ABSTRACT

This invention comprehends a two-cycle internal combustion engine using compression relief to provide a dual compression ratio. Compression relief ports above the exhaust ports of two cylinders firing 180 degrees out of phase connected by a relief passage. The passage is vented at its midpoint. At higher engine speeds exhaust flow, from the cylinder in its power stroke, through the relief passage, blocks the flow from the cylinder in its compression stroke.

16 Claims, 12 Drawing Figures

COMPRESSION RELIEF SYSTEM FOR INTERNAL COMBUSTION ENGINE

DESCRIPTION

1. Technical Field

This invention relates to internal combustion engines, and more particularly, relates to two-cycle internal combustion engines having a compression relief system to provide a dual compression ratio, a low or minor compression ratio for starting and running the engine at slow speed and a high or major compression ratio for running the engine at midrange and high speeds.

2. Background Art

Two-cycle internal combustion engines have been improved over the years by increasing the fuel economy, and the efficiency and providing more power per unit weight of the engine. In one way or another, all of these improvements have been provided, in part, by an increase in compression ratio of the engine. This increase in compression ratio has produced undesirable side effects such as:

(1) more force required to start the engine; and (2) rough idling and running of the engine at low speeds.

Some attempts have been made to modify the structure of existing two-cycle engines so that they could have a low compression ratio for starting or running at slow speeds and a high compression ratio for running at midrange and high speeds. One attempt to lower the compression ratio during engine starting and idling was made in a model of the Mariner outboard engine wherein a groove or notch was fashioned at the top edge of the exhaust port of a two-cycle engine. Another attempt to solve this problem was tried on one of the Suzuki motorcycle engines where a hole was positioned just above the exhaust port of one cylinder. This hole was connected directly to the exhaust duct adjacent the exhaust port. These devices provided adequate performance at low speeds, but reduced the peak torque.

DISCLOSURE OF INVENTION

This invention relates to a two-cycle internal combustion engine, and more particularly, to a two-cycle internal combustion engine that has an even number of cylinders. The invention provides a two-cycle internal combustion engine using a compression relief system to provide a dual compression ratio. The invention comprehends a first high compression ratio (about 7 to 1 or more) for operating at high speeds of about 2,500 to 3,300 rpm or more and a second compression ratio (about 5 to 1) for starting and running the engine smoothly at idle and slow speeds. All ranges of speeds for the engine were found to produce good fuel economy and good fuel to power ratio.

One object of this invention is to provide for such an engine wherein small pressure relief hole means are made in the side walls of the cylinders closer to the top of the cylinder than the exhaust ports.

Another object of this invention is the provision for such an arrangement to be applied to any two-cycle internal combustion engine with an even number of cylinders.

Another object of this invention is the provision for such an engine wherein the small hole means of two cylinders are connected together and the pistons operate 180 degrees out of phase.

Yet another object of this invention is the provision for a relief chamber located between the two small hole means.

Still another object of this invention is the provision for connecting the relief chamber to the exhaust system of the engine.

Still another object of this invention is to provide an arrangement whereby the small hole means are essentially blocked when the engine runs at high speeds, such as 3,000 rpm or more, thus the engine is operating at a high compression ratio.

Yet another object of this invention is to provide an arrangement whereby the small hole means function during the starting of the engine or when the engine is running at idle or slow speeds thus providing the engine with a low compression ratio.

The above and other and further objects and features will be more readily understood by reference to the following detailed description and the accompanying drawings.

BEST MODE FOR CARRYING OUT THE INVENTION

Figure 1:
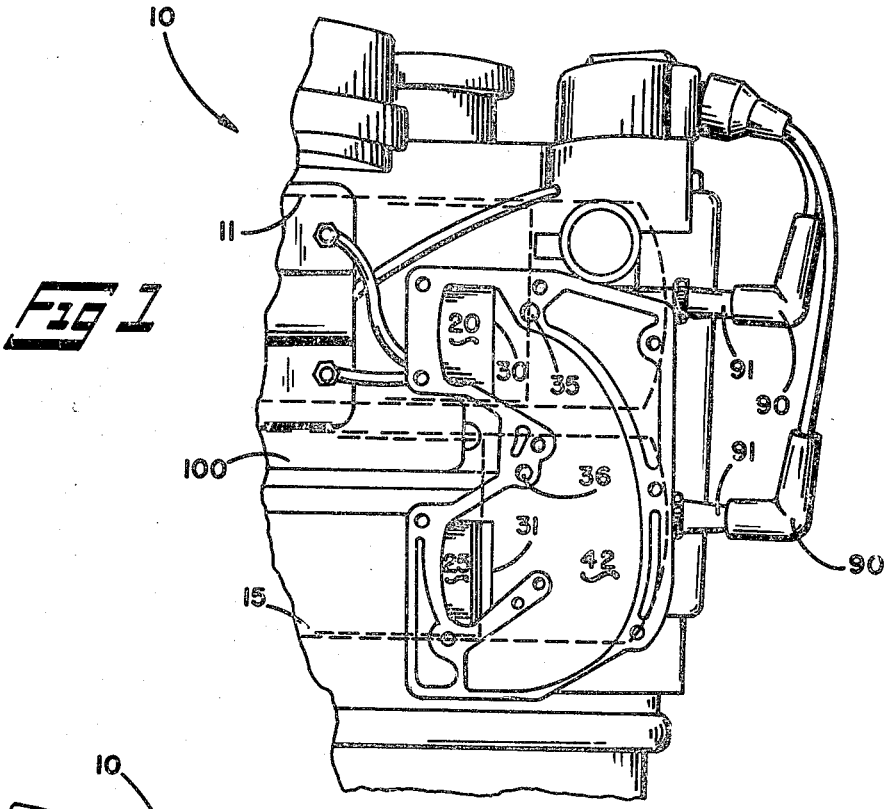
FIG. 1 is a partial cross-sectional side elevation view of a portion of the engine containing the invention described herein.
Figure 2:
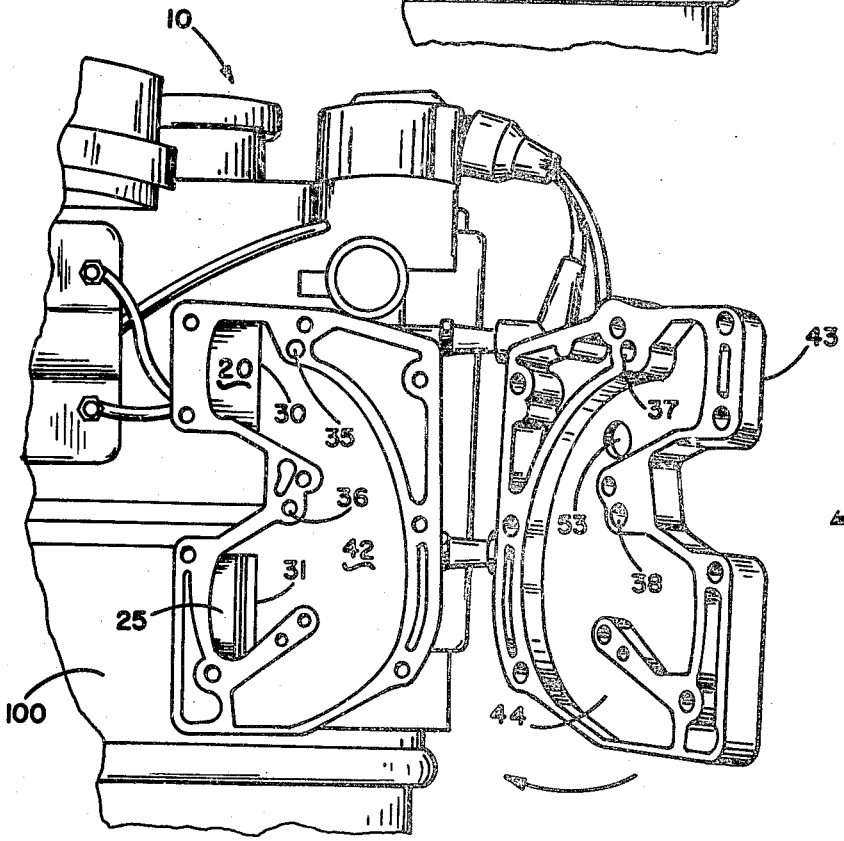
FIG. 2 is a partial cross-sectional elevation view of a portion of the engine containing the invention described herein coupled with a hinged view of the inner surface of the manifold cover.

In the preferred embodiment of the invention, a portion of an internal combustion two-cycle engine is shown in FIGS. 1 and 2. In FIG. 1, the upper or first piston 20, in its compression stroke has closed off the first exhaust port 30 of the first cylinder 11 (shown in phantom by a dash line). Adjacent to the first piston 20 the second piston 25 in cylinder 15 (shown in phantom by a dash line) has begun to open the second exhaust port 31 at the end of the power stroke. Spark plug covers 90 enclose a portion of spark plug 91. The pistons 20 and 25 are connected to a crank shaft (not shown) by connecting rods (not shown). A pressurized air-fuel mixture enters the cylinders 11 and 15 by means of inlet ports 40 and 41 when the pistons 20 and 25 are at the bottom of their respective strokes.

The first and second pistons operate 180 degrees out of phase whereby when the first piston 20 is at the top of its stroke, as close to the spark plug 91 as possible, the second piston 25 is at the bottom of its stroke so that the air-fuel mixture can enter the cylinder 15 through inlet 41. The air-fuel mixture is generally in the form of a gaseous mixture and once it enters the cylinder 11 or 15 it is compressed as soon as the piston 20 or 25 closes off the exhaust port 30 or 31.

Figure 3:
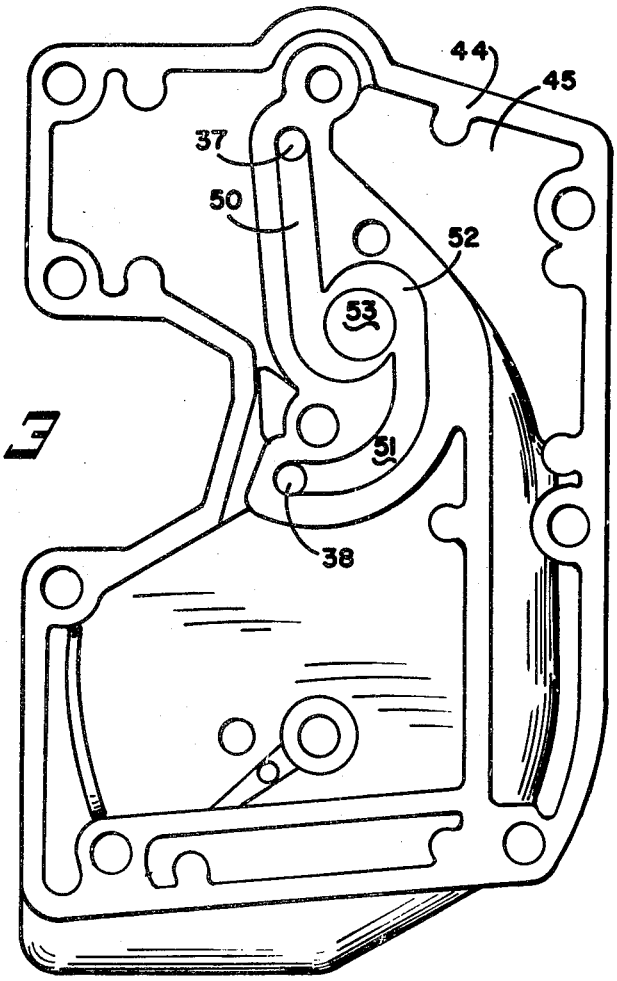
FIG. 3 is a side elevation view of the outside surface of the manifold cover depicting a portion of the invention described herein.
Figure 5:
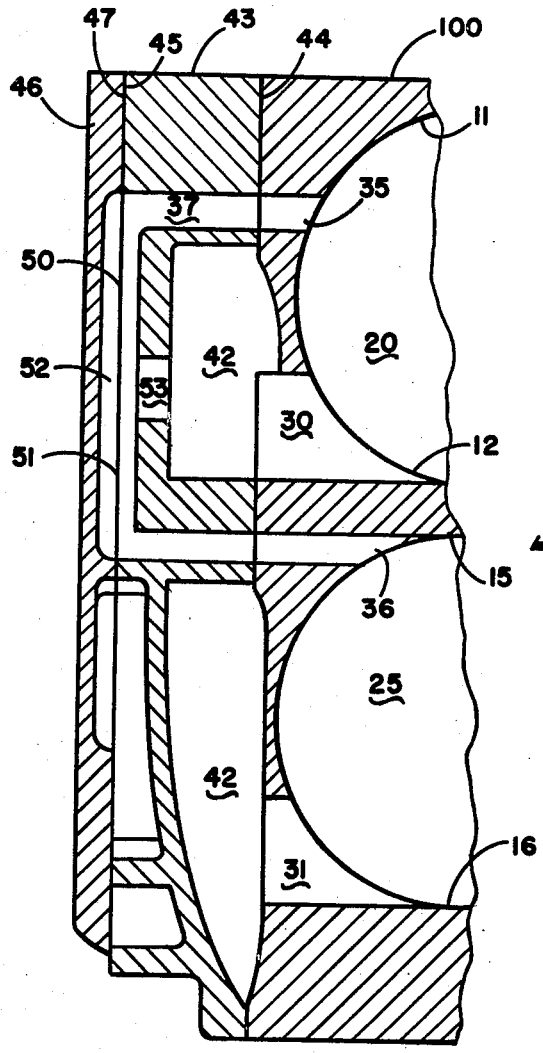
FIG. 5 is a partial cross-sectional view depicting the engine block, manifold and cover plate incorporating the invention described herein.

In the invention as shown herein, an exhaust plenum 42 is formed by the engine block 100 and the manifold exhaust cover 43. The inside 44 of the cover 43 is shown folded back in a hinged fashion in FIG. 2. The outer surface 45 of the cover 43 is shown in FIG. 3. Relief hole means 35 and 36 pass from the inside of cylinders 11 and 15 to the outside of the engine block and are located closer to the tops 13 and 17 than the exhaust ports 30 and 31, as shown in FIGS. 1 and 2.

Figure 4:
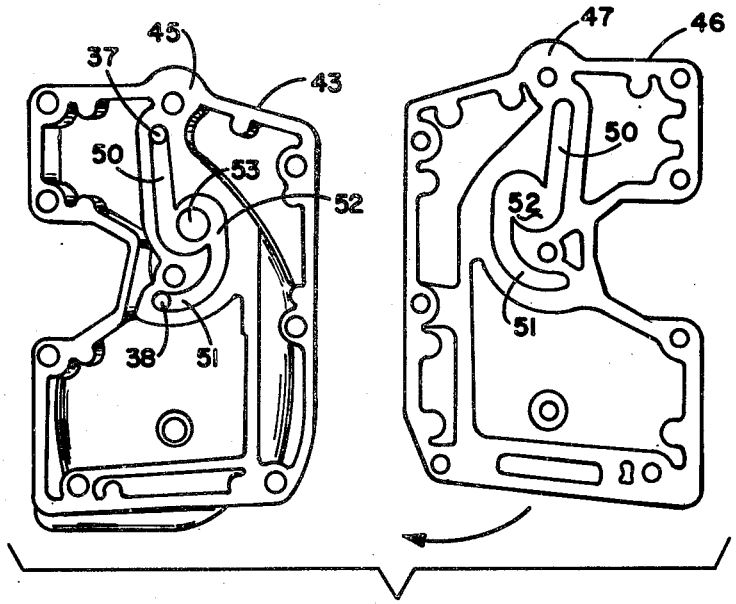
FIG. 4 is a hinged type of side elevation view of the outer surface of the manifold cover and the engine surface of the cover plate depicting a portion of the invention described herein.

Relief passageways 37 and 38 and cover 43 mate with hole means 35 and 36 and provide openings on the outer surface 45. Cover plate 47 with interior surface 47 encloses the outer surface 45 of the cover 43. Both the cover 43 and the plate 47 can be made of the same metal as the engine block 100 and can be fastened to the engine block 100 by means of bolts (not shown). Formed into the outer surface 45 of the cover 43 and the inside or interior surface 47 of the plate 46 are first and second relief channels 50 and 51. The channels converge into relief chamber 52. Both the channels 50 and 51 and the chamber 52 can be formed by cutout sections in both the outer surface 45 and the interior or inside surface 47. A vent opening 53 connects the relief chamber 52 with the exhaust plenum 42. In the preferred embodiment the cross-sectional areas of the channels 50 and 51 are the same as the cross-sectional area of the hole means 35 and 36. Further, it has been found, in some instances, that the relief chamber 52 should have the same thickness as the thickness of the channels 50 and 51 or a thickness that is equivalent to the diameter of the hole means 35 and 36. FIG. 4 depicts the manifold cover 43 and the cover plate 46 in a hinged arrangement whereby the outer surface 45 and the inner surface 47 mate forming the channels 50 and 51 and relief chamber 52.

Figure 12:
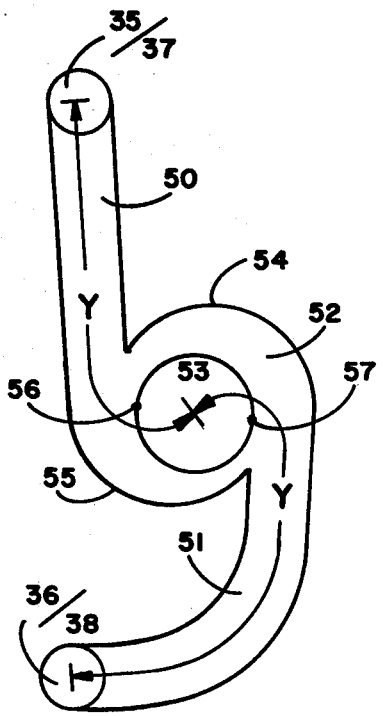
FIG. 12 is a view of one part of one embodiment of the invention described herein.

In order for the invention to operate optimumly, it has been found preferable to have the distance "Y" between the hole means 35 and 36 and the center of vent hole 53 substantially equal, as shown in FIG. 12, when the hole means 35 and 36 and the channels 50 and 51 are of about the same cross-sectional area. This arrangement permits for the equal fluid flow and equal pressure drops between the hole means 35 and 36 and the vent hole 53. In the preferred embodiment the relief chamber 52 has two circular arc walls 54 and 55 which, if extended, would be nearly tangent to the walls of vent hole 53 at points 56 and 57. The passages 50 and 51 are also tangent to vent hole 53 at the same points 56 and 57.

In the preferred embodiment of the invention, the top edges 32 and 33 of exhaust ports 30 and 31, together with the travel of the pistons 20 and 25, determine the first, high or main compression ratio of each cylinder. The compression ratio of a two-cycle engine is determined by the ratio of (1) the volume of the cylinder 11 or 15 just after the exhaust ports 30 or 31 are closed compared to (2) the volume in the cylinder 11 or 15 when the piston 20 or 25 is at the top of its stroke (nearest to the spark plug 91). It is generally necessary for each cylinder of an engine to have the same compression ratio. In such two-cycle internal combustion engines, it has been found desirable to have a main or high compression ratio of about 7 to 1 or more in order for the engine to obtain good fuel economy and provide adequate performance at high engine speeds in the range of 3,000 to 5,000 rpm or even more. Two-cycle engines with compression ratios of 7 to 1 (or more) are more difficult to start than engines with lower compression ratios, such as 5 to 1. However, a two-cycle engine with the compression ratio of 5 to 1 does not provide a high performance engine and is not suitable for many uses including marine power uses. One of the characteristics of high compression ratios (7 to 1 or more) engines is that they have a tendency to idle roughly.

It was found that small openings, such as relief hole means 35 and 36 could be placed in the side walls 12 and 16 of the engine block 100 closer to the tops 13 and 17 than the exhaust port 30 and 31 and thereby provide compression relief to reduce the compression ratio of the engine 10. The hole means 35 and 36 made the engine 10 easier to start and idle smoothly at speeds of about 600 to 800 rpm.

Quite surprisingly it was found that with the two small relief hole means 35 and 36 in the adjacent cylinders 11 and 15 connected together and the connecting means vented, the engine would start easily, as if it had a compression ratio of 5 to 1, and further that the engine idled smoothly at speeds ranging from 600 to 1,000 rpm. Also, it was quite surprisingly found that as the engine speed was increased to speeds ranging from 3,000 to 5,000 rpm and even more, that the engine produced good gas economy, high power and performance and performed as well as, if not slightly better than the engine did when it only had a single compression ratio of approximately 7 to 1 or more.

Thus, the engine operated very satisfactorily with compression relief providing two compression ratios:

(1) a first or major compression ratio of about 7 to 1 or more when the engine was running at high speed (3,000 rpm and up); and (2) a second or minor compression ratio of about 5 to 1 when the engine was being started or running at idle speeds of from about 600 rpm to 800 rpm or slow speeds of about 800 rpm to about 1,500 rpm.

Figure 6:
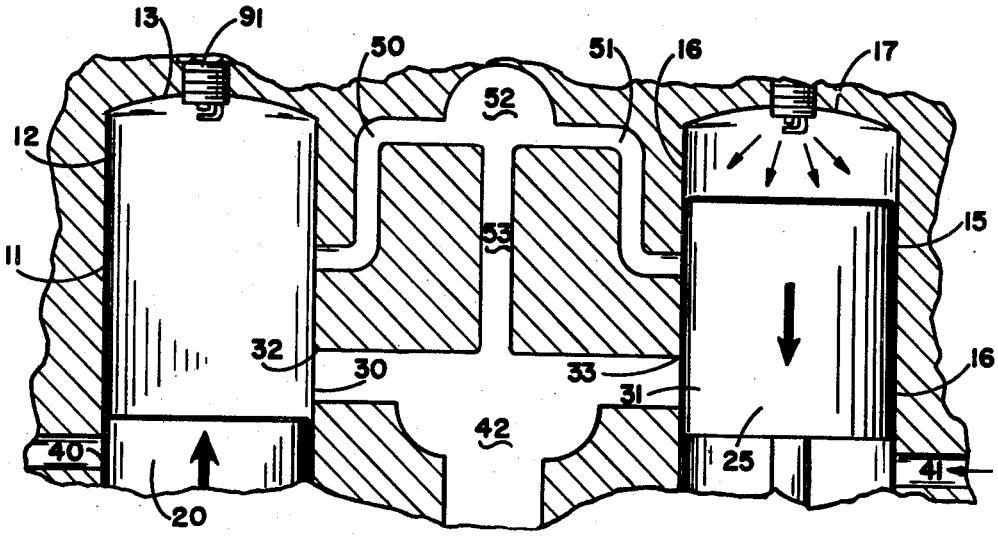
FIG. 6 is a partial schematic cross-sectional side view depicting the invention described herein.
Figure 7:
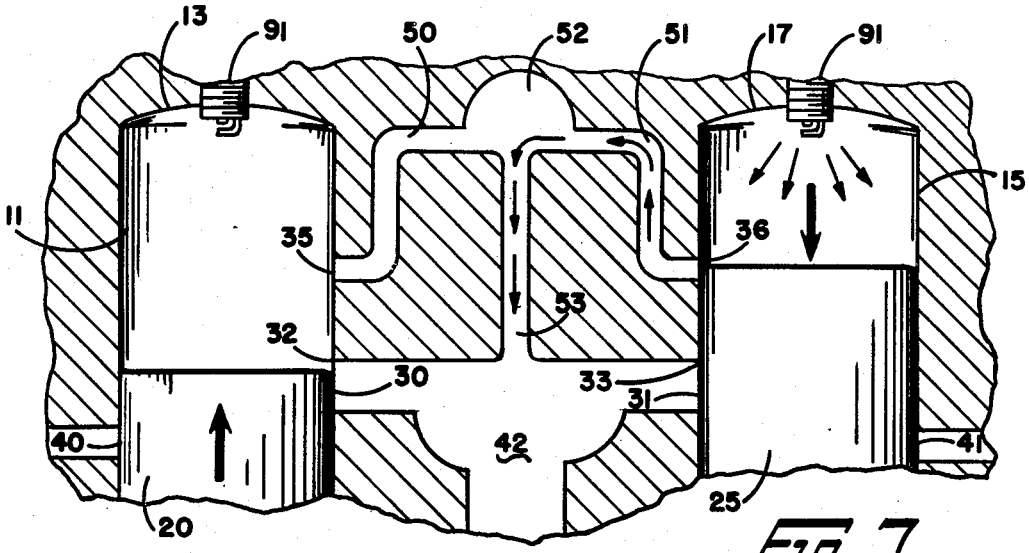
FIG. 7 is a partial schematic cross-sectional side view depicting the invention described herein.

At slow speeds, such as idle speed, the burned air-fuel mixture in a cylinder has a greater gas pressure than the air-fuel mixture that has entered the inlet port of the adjacent cylinder and is about to be compressed. It is believed that the two compression ratios of the invention comprehended herein can be explained by reference to the schematic diagrams found in FIGS. 6, 7, 8 and 9 which depict one part of the cylce and the interaction between the pistons in two adjacent cylinders. In each of these figures, the engine is depicted at about the idle speed range. In FIG. 6, the first piston 20 is moving upward toward the top 13 just having closed off the inlet port 40 and forcing the last remnants of exhaust gases out through exhaust port 30. Most of the gas in cylinder 11 is the air-fuel mixture. Simultaneously in cylinder 15, the air-fuel mixture has been burnt or is burning creating exhaust gases at high pressures and forcing the piston 25 downward. Since the exhaust port 30 of the cylinder 11 is open and relief port 36 of cylinder 15 is closed, there is very little, if any, gas movement in channels 50 and 51. As the piston 25 moves farther downward, as depicted in FIG. 7, the relief port 36 is opened to the inside of cylinder 15 wherein exhaust gases are forced under high pressure outward into channel 51 and chamber 52 where the flow is directed away from channel 50, and out vent opening 53. The vent hole 53 is sized to permit greater flow therethrough than the restricted flow existing in channel 51, thus producing a lower pressure in chamber 52 to help prevent flow from the chamber 52 out channel 50. Simultaneously, the piston 20 has moved up and is just about to close off the exhaust port 30 and begin compressing the air-fuel mixture.

Figure 8:
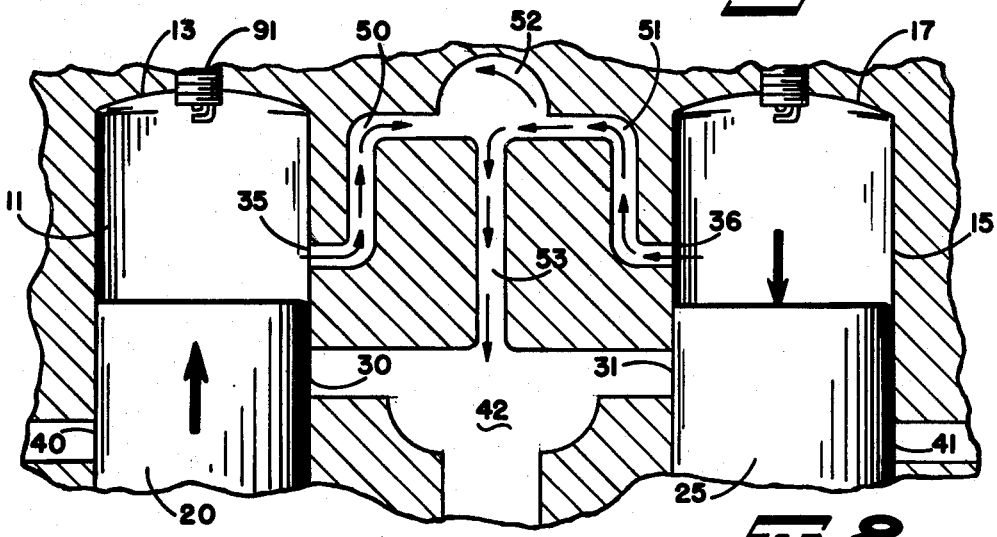
FIG. 8 is a partial schematic cross-sectional side view depicting the invention described herein.

As piston 20 continues moving upward toward the top 13, as shown in FIG. 8, the air-fuel mixture is compressed and begins to exit through hole means 35 into channel 50. At the same time, the exhaust gases are under decreasing pressure in the channel 51 and the relief chamber 52 as the power stroke continues and the exhaust gases are vented through hole 53. As a result the air-fuel mixture from cylinder 11 begins to vent out hole 53.

Figure 9:
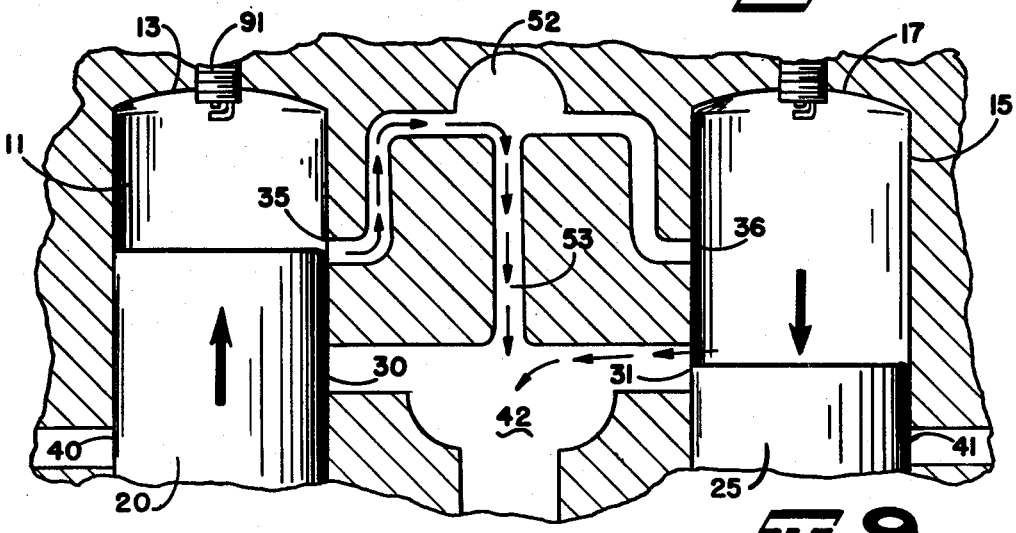
FIG. 9 is a partial schematic cross-sectional side view depicting the invention described herein.

As the piston 20 continues to move upward, the air-fuel mixture pressure is increased and a greater portion of the mixture is forced out vent 53. At the same time, the piston 25 has moved downward to a position where the exhaust port 31 is open, as shown in FIG. 9, with a majority of the exhaust gases now rushing outward toward the lower pressure region in the exhaust plenum 42. The opening of the exhaust port 31 causes the exhaust gases present in the channels 50 and 51 to stop any movement toward the hole means 35 and greatly increases the flow of air-fuel mixture out vent 53.

After the piston 20 has reached its topmost position and the air-fuel mixture is ignited by the spark plug 91 and the mixture is burned, the piston 20 begins moving downward in its power stroke. Simultaneously, the piston 25 begins moving upward in its compression stroke. Thus, the relative positions of the pistons 20 and 25 are reversed compared to the positions shown in FIGS. 6 through 9 and the compression relief cycle described above repeats itself for cylinder 15.

Figure 10:
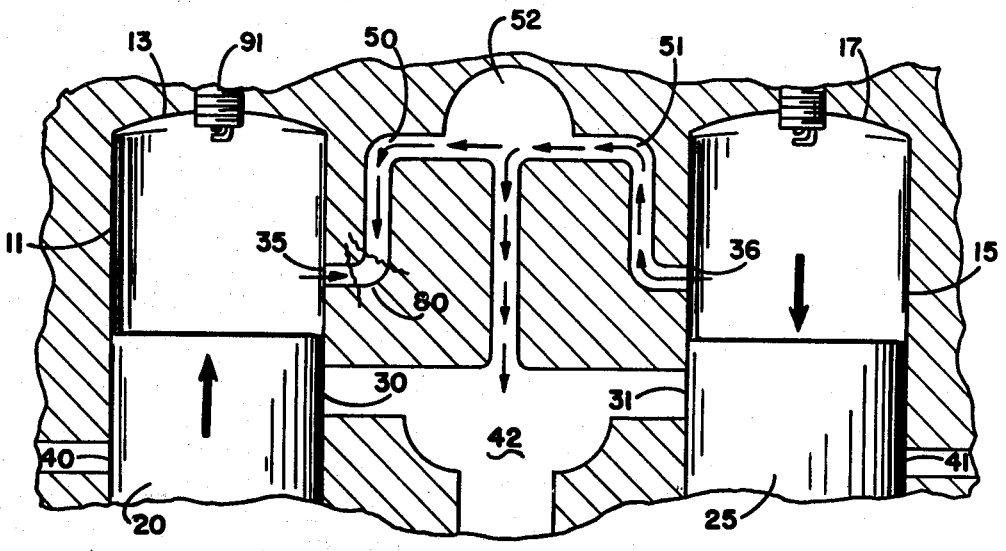
FIG. 10 is a partial schematic cross-sectional side view depicting the invention described herein when the engine is operating at the major or high compression ratio.
Figure 11:
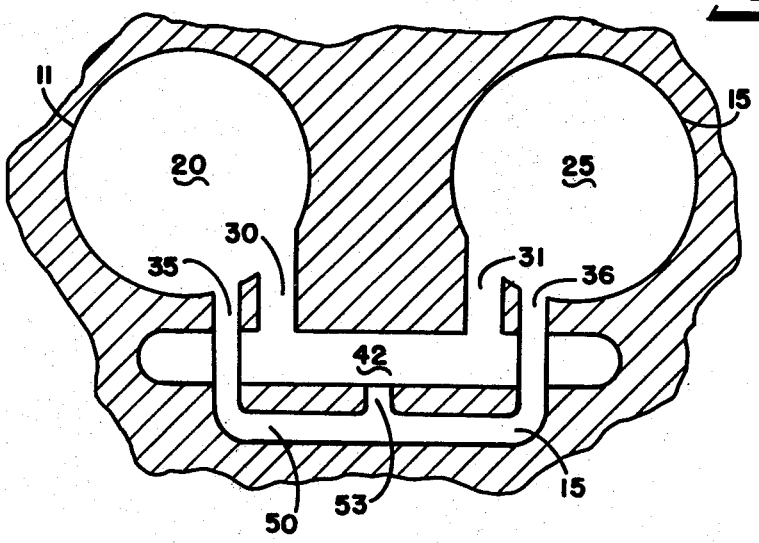
FIG. 11 is a schematic top cross-sectional view depicting a part of the invention described herein.

At high speed the exhaust gases are under higher pressure while the air-fuel mixture pressures do not significantly increase. Thus it is believed that the increased exhaust pressure in relief chamber 52 serves to essentially block the flow of air-fuel mixture into the relief chamber 52. It is further believed that an exhaust pressure pulse from the opening of relief hole 36 travels up channel 50 to further block the flow of air-fuel mixture out relief hole 35 as shown in FIG. 10. Thus, the pair of connected cylinders experiences a low (about 5 to 1) compression ratio at idle or slow speeds (600 rpm–1,500 rpm) and a high (about 7 to 1 or more) compression ratio at speeds over 3,000 rpm.

The invention described herein was incorporated into a loop scavenged 25 horsepower, two-cylinder, outboard motor having a displacement of 24.4 cubic inches, a cylinder bore of 2 9/16 inches, and a stroke of 2⅛ inches. The engine initially had a compression ratio of about 7.3 based upon the location of the exhaust ports relative to the top of the cylinders. At cranking speed, there was approximately 130 psi pressure inside the cylinders when the air-fuel mixture was being compressed. Two small holes approximately 3/16 inch in diameter were drilled into each one of the cylindrical cavities and connected together in a manner similar to the holes previously described in FIGS. 1 and 2. The distance between the center lines of the two small holes and the top edge of the exhaust ports was approximately 0.470 inch. A manifold cover was placed over the exhaust ports with two channels and a plenum chamber mounted therein similar to the configurations shown in FIGS. 2 through 5. The channels 50 and 51 had a cross-sectional dimension of about 3/16 inch and length of about 3½ inches and the plenum 52 had a major diameter ranging from about ¾ inch to ⅞ inch and a minor diameter ranging from about ½ inch to 11/16 inch. The plenum 52 had a central hole 53 with a diameter of about 7/16 inch and was connected to the exhaust cavity 42. In both cylinders the relief holes 35 and 36 were positioned to open 75 degrees of crank shaft rotation after the piston was at top center and the exhaust ports 30 and 31 began to open at 102 degrees after top center.

Thus, this engine had a dual compression ratio. The major or higher compression ratio was 7.3 to 1 and the lower or minor or second compression ratio, based upon the location of the relief holes in the cylinders, was 5 to 1. The lower compression ratio produced an air-fuel mixture pressure of about 90 to 100 psi in the cylinders at cranking speed. The engine was tested at a series of rpms ranging from idle speed of about 600 rpm to high speed at 5,000 to 6,000 rpm. The test indicated that the engine started and performed at low speeds much better than it performed with the one compression ratio, while maintaining its performance at high speeds.

It is desirable that the cylinders be in a paired arrangement whereby the position of the pistons were 180 degrees out of phase with each other. Consequently, the invention comprehended herein can be incorporated into two, four, six, eight, or even more, cylinder two-cycle engines as long as the paired cylinders have pistons 180 degrees out of phase.

Although specific embodiments of the invention have been described, many modifications and changes may be made in the internal combustion engine described herein having a dual compression ratio without departing from the spirit and scope of the invention as defined in the appended claims.

I claim:

1. A two-cycle internal combustion engine comprising:

(A) at least one pair of cylinders, said cylinders being closed at one end;

(B) a piston mounted for reciprocation in each of said cylinders;

(C) at least one exhaust port in each of said cylinders;

(D) a compression relief means to relieve compression in each of said cylinders during the compression stroke of the corresponding one of said pistons; and (E) a means using exhaust pressure from one cylinder to prevent said compression relief means from operating on the other cylinder at relatively high engine speeds.

2. The engine defined in claim 1 wherein said relief means comprises relief ports in the walls of said cylinders.

3. The engine defined in claim 2 wherein said relief ports are located between said exhaust ports and the closed ends of said cylinders.

4. The engine defined in claim 2 wherein said means to prevent comprises a passage means connecting the relief ports of said cylinders.

5. The engine defined in claim 4 wherein said passage means comprises a vent connecting said passage means to a region of relatively low pressure.

6. The engine defined in claim 5 further comprising an exhaust manifold connected to said exhaust ports and said region of low pressure is in said exhaust manifold.

7. The engine defined in claim 4 wherein said passage means comprises a relief chamber of generally cylindrical shape, two passages connecting the relief chamber to said relief ports, and a vent in said relief chamber connecting said relief chamber to a region of relatively low pressure.

8. The engine defined in claim 7 wherein said passages are oriented to impart a vortex action to the gas entering said relief chamber.

9. The engine defined in claim 8 wherein said two passages enter said relief chamber from opposite directions.

10. The engine defined in claim 9 wherein said opposite directions are essentially parallel.

11. The engine defined in claim 10 wherein said vent is oriented perpendicularly to said parallel passages.

12. The engine defined in claim 11 wherein said two passages enter said relief chamber tangentially.

13. The engine defined in claim 2, 4, or 11 wherein said pistons are connected to a crankshaft to operate 180 degrees out of phase.

14. The engine defined in claim 13 wherein said relief ports are positioned at the same axial position in each cylinder.

15. The engine defined in claim 14 wherein each one of said relief ports are positioned to be opened by the piston on its power stroke prior to the closing of the other relief port by the piston on its compression stroke.

16. The engine defined in claim 15 wherein said relief ports are positioned to be opened by the piston on its power stroke in one cylinder before the exhaust port in the other cylinder is closed by the piston on its compression stroke.

* * * * *